United States Patent [19]

Zen

[11] Patent Number: 4,660,648

[45] Date of Patent: Apr. 28, 1987

[54] FLUSH TYPE SPRINKLER HEAD

[75] Inventor: Mitsuo Zen, Soka, Japan

[73] Assignee: Senju Metal Industry Co., Ltd., Tokyo, Japan

[21] Appl. No.: 741,356

[22] Filed: Jun. 5, 1985

[30] Foreign Application Priority Data

Jun. 7, 1984 [JP] Japan ..... 59-83643[U]

[51] Int. Cl.[4] ..... A62C 37/08

[52] U.S. Cl. ..... 169/38; 169/37; 169/41; 169/42

[58] Field of Search ..... 169/37, 38, 39, 40, 169/41, 42

[56] References Cited

U.S. PATENT DOCUMENTS

| | | | |
|---|---|---|---|
| 3,459,266 | 8/1969 | Ault | 169/37 |
| 3,714,989 | 2/1973 | Gloeckler | 169/42 X |
| 4,014,388 | 3/1977 | Anderson | 169/42 X |
| 4,015,665 | 4/1977 | Simons et al. | 169/42 X |
| 4,139,062 | 2/1979 | Rago | 169/37 |

*Primary Examiner*—Joseph F. Peters, Jr.
*Assistant Examiner*—Patrick N. Burkhart

[57] ABSTRACT

There is provided a flush type sprinkler head to be installed in the ceiling of a building, the sprinkler protruding out of the ceiling by a small distance. The sprinkler head comprises a main body defining a nozzle having a valve seat at the lower end, a cylindrical frame having a radially inwardly extending flange at the lower end, a valve member normally abutting against the valve seat to close the nozzle, a slidable deflector assembly fitting on the valve member and including a guide ring having slide bars extending downwardly from the guide ring and a deflector slidable along the slide bars, a coil spring interposed between the main body and guide ring and a break-up closure assembly adapted to break into pieces at rise in the temperature at the installation area of the sprinkler head and including a thermally responsive element.

4 Claims, 8 Drawing Figures

FLUSH TYPE SPRINKLER HEAD

BACKGROUND OF THE INVENTION

This invention relates to a flush type sprinkler head adapted to be installed in a building ceiling for fire protection, and having a deflector which is housed in the main body of the sprinkler head and adapted to drop out of the main body to uniformly distribute fire extinguishing agents sprayed from the sprinkler head in case of a fire.

Of late, skyscrapers have been in most cases built with low ceilings storeys in order to increase the number of storeys in each skyscraper. Thus, a sprinkler head to be installed in the low ceiling should protrude out of the ceiling surface as little as possible. The reason is that if the sprinkler head protrudes substantially out of the ceiling surface, the sprinkler head is liable to be hit and as a result, the fire extinguishing agent is untimely sprayed (which is called as "spontaneous discharge" in the art) even when no fire breaks out in the environment where the sprinkler head is installed. A substatial protrusion of the sprinkler head out of the ceiling surface is also aesthetically undesirable.

Therefore, the sprinkler head of the flush type which can be embedded in the ceiling is suitable for the low ceiling.

The flush type sprinkler head normally houses the deflector within the main body and when it senses a fire occurring in the area of the sprinkler head, the deflector drops out of the main body by a predetermined distance so that the fire extinguishing liquid is caused to impinge against the dropped deflector which then distributes the liquid in all directions. Thus, during the operation of the sprinkler head, the deflector should be positioned in a lowered position sufficient to ensure a stabilized spraying condition for the fire extinguishing liquid or in a position spaced from the ceiling surface by at least a distance. For this reason, the installation position of the sprinkler head in the ceiling is selected taking the dropped position of the deflector into consideration.

In order to allow the deflector to drop by a greater distance from the ceiling surface, it may be contemplated that the sprinkler head is embedded in the ceiling in a shallow depth with a substantial portion of the head projecting out of the ceiling surface. However, when a substantial portion of the sprinkler head projects out of the ceiling surface, the sprinkler head is liable to be hit as mentioned hereinabove and undesirable with respect to aesthetic point of view.

In order to install the flush type sprinkler head with only a small portion thereof projecting out of the ceiling surface so as to increase the downward movement distance of the deflector, the slidable members associated with the deflector of the slide bars secured to the deflector may be increased in their length. However, the long slidable members essentially necessitates increasing the length of the main body. However, the sprinkler head having the long main body has to be embedded in the ceiling in an increased depth to cause a substantial portion of the main body to project out of the back side of the ceiling which causes a problem in the installation of the piping in the ceiling. In short, since the sprinkler head is threadably engaged with the piping on the back side of the ceiling and the piping should be firmly secured to the ceiling back side against swinging and/or dangling, the portion of the sprinkler head projecting out of the ceiling back side interferes with the securing of the piping to the ceiling.

Thus, it is desirable to provide a flush type sprinkler head which projects out of both the opposite sides of the ceiling by a small distance and provides a long downward movement distance of the deflector, but unfortunately, such a flush type sprinkler head has not been provided so far. Under the circumstances, the art has been compelled to use the flush type sprinkler head which projects out of the surface or back side of the ceiling by a substantial distance though such a flush type sprinkler head has its inherent drawbacks.

And when the prior art flush type sprinkler head is installed in an inclined location such as the ceiling over a stairway or escalator, if no water pressure is applied to the sprinkler head under particular abnormal conditions, the deflector of the sprinkler head at times does not drop properly resulting in uneven spray of the fire extingushing liquid by the sprinkler head. The cause of such uneven spray is that since the deflector of the sprinkler head is designed to drop by its own gravity along the wall surface and/or nozzle of the sprinkler head, the deflector of the sprinkler head installed in the inclined ceiling does not drop vertically with respect to the main body of the sprinkler head, but tilts under its own gravity and ceases its downward movement halfway while maintaining the tilted position.

SUMMARY OF THE INVENTION

The present invention provides a flush type sprinkler head in which the deflector can positively drop to a predetermined position by extending the drop distance of the deflector even when the sprinkler head is installed in an inclined position and/or has a relatively short main body.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
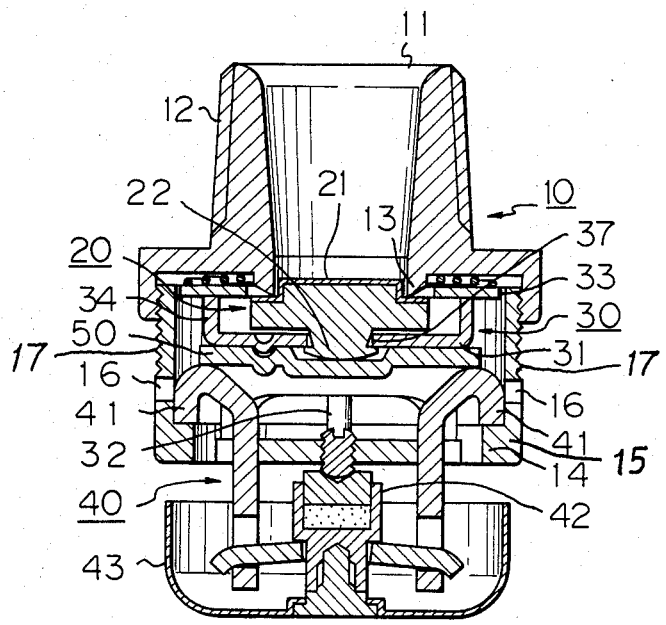
FIG. 1 is a vertical sectional view of the flush type sprinkler head embodying the principle of the present invention taken along the vertical axis of the sprinkler head.

The present invention will be now described referring to the accompanying drawings. The flush type sprinkler head generally comprises as principal components a main body 10, a valve member 20, a slidable deflector assembly 30, a break-up closure assembly 40 having arms 41 and a conical coil spring 60.

Figure 6:
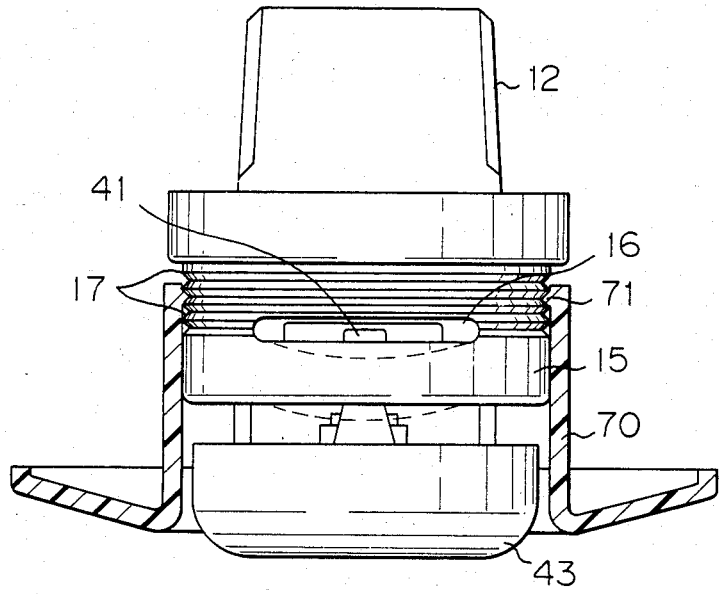
FIG. 6 is a fragmentary vertically sectional view showing the bending of the slits in the cylindrical frame and the engagement of the ceiling plate with the cylindrical frame.

The main body 10 has a center opening to provide a nozzle 11 and external threads 12 in an upper portion thereof for threadable engagement with a piping (not shown) in a building ceiling. The lower end of the nozzle 11 is formed with a valve seat 13. A cylindrical frame 15 is in threadable engagement with the outer periphery of the valve seat 13 and has a radially inwardly extending flange 14 at the lower end of the frame. Formed in the peripheral wall of the cylindrical frame 15 in diametrically oppositing relationship are horizontal slits 16 each having rounded opposite ends. The slits allow the frame 15 to resiliently engage the break-up closure assembly 40. When the arms 41 of the break-up closure assembly 40 engage the center of the lower edges of the slits 16, the lower edges of the slits bend downwardly as shown by the dotted line in FIG. 6. Thus, when the sprinkler head is operated, the break-up closure assembly 40 can positively break into pieces which scatter outwardly in all directions whereby the break-up closure assembly will not stand in the way of the extinguishing liquid being sprayed. Since the opposite ends of the slits 16 are rounded, when load is applied to the lower edges of the slits 16, the load is effectively dispersed whereby the slits can be protected against possible damage. The outer peripheral surface of the frame 15 is formed with a plurality of spaced horizontal grooves 17 and as shown in FIG. 6, a ceiling plate 70 is selectively fitted on the grooves 17. When the grooves 17 are formed in an upper portion of the cylindrical frame 15, the annular projection 71 at the upper end of the inner surface of the ceiling plate 70 can engage the frame 15 over a wide range.

A packing 21 is positioned on the top of the valve member 20 and a projection 22 extends downwardly from the undersurface of the valve member 20. The valve member normally abuts against the valve seat 13 to close the nozzle 11.

Figure 2:
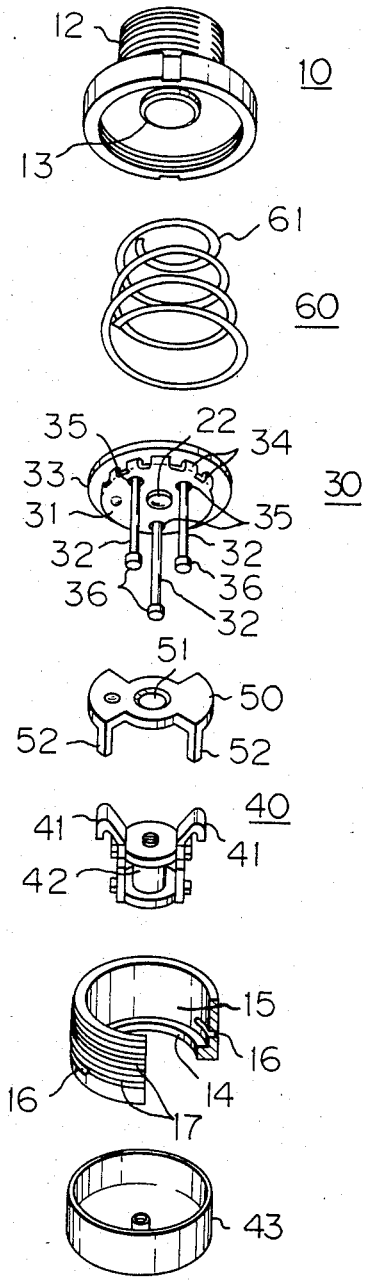
FIG. 2 is an exploded perspective view of the sprinkler head.
Figure 3:
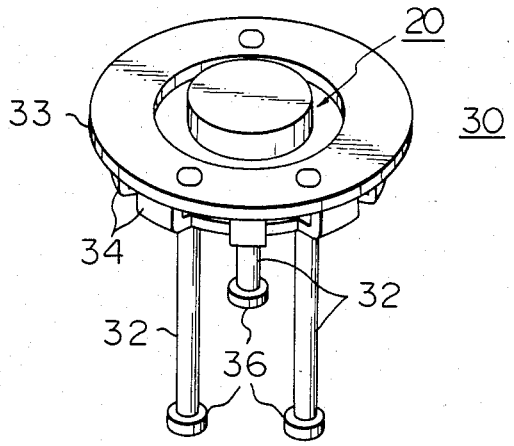
FIG. 3 is a fragmentary perspective view on an enlarged scale of the deflector assembly of the sprinkler head.
Figure 4:
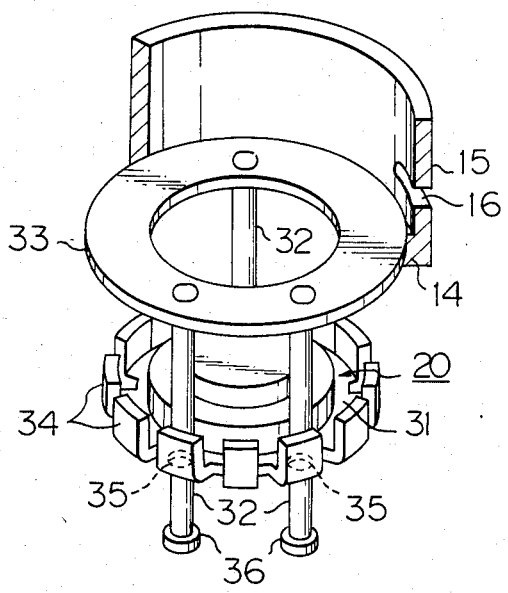
FIG. 4 is substantially similar to FIG. 3, but shows the deflector in its dropped position and also a portion of the cylindrical frame formed with slits.

As more clearly shown in FIGS. 2, 3 and 4, the slidable deflector assembly 30 (the deflector assembly is shown midway in its downward movement or drop in FIG. 4) consists of a deflector 31, a plurality of slide bars or legs 32, 32, 32 and a guide ring 33. The deflector 31 is in the form of an annulus and has a plurality of circumferentially spaced blades 34 extending uprightly at the periphery of the deflector. The annulus of the deflector 31 is also formed with a plurality of circumferentially spaced guide holes 35, 35, 35 for slidably receiving the slide bars 32 therein, respectively. The slide bar 32 has a stop 36 secured to the lower end thereof and is secured at the upper end to the guide ring 33. The annulus of the deflector 31 is formed in the center thereof with a valve member support hole 37 in which the projection 22 on the valve member 20 is slidably fitted. The deflector 31 has an outer diamter which is greater than the inner diameter of the radially inwardly extending flange 14 of the frame 15 and the guide ring 33 has the outer diameter slightly smaller than the inner diameter of the cylindrical frame 15, but greater than the inner diamter of the flange 14. In the flush type sprinkler head according to the present invention, the slidable deflector assembly 30 is so arranged that the valve member 20 normally seats on the valve seat 13 to close the nozzle 11 and thus, the deflector 31 fitting on the valve member 20 is normally positioned above the flange 14. And the guide ring 33 is also upheld in a positioned above the flange 14 by the blades 34 . . . of the deflector 31.

As more clearly shown in FIG. 2, the conical coil spring 60 is not uniform in diameter throughout its length, but tapers from one end towards the other end. According to the present invention, the coil spring 60 is disposed between the undersurface of the main body 10 and the top of the guide ring 33 with the smaller diameter end 61 of the coil spring surrounding the valve seat 13 of the nozzle 11. The coil spring 60 is normally compressed to a flattened condition to urge the guide ring 33 downwardly. It will be noted that when the coil spring 60 is in its compressed condition, the adjacent turns of the spring do not lie one upon another are disposed substantially in the same horizontal plane. Thus, the area for receiving the coil spring can be minimized and the flush type sprinkler head of the invention can be made compact.

The break-up closure assembly 40 consists of two diametrically oppositely disposed arms 41, 41, a thermally responsive element 42 and other conventional parts (not shown). The two arms 41 engage both the radially inwardly extending flange 14 on the frame 15 and the thermally responsive element 42 and apply force to the valve member 20 through a combined presser and guide 50. The combined presser and guide 50 has a hole 51 in the center of the top thereof for pivotally supporting the projection 22 on the valve member 20 and four spaced legs 52 which have a length at least sufficient to reach the radially inwardly extending flange 14 of the frame 15. Diametrically opposite areas of the undersurface of the combined presser and guide 50 are subjected to the force from the arms 41 of the break-up assembly 40. Details of the construction of the break-up closure assembly have been known (see Japanese Utility Model Reg. No. 1,254,702) and do not constitute any part of the present invention. Thus, description on the construction of the break-up closure assembly 40 will be omitted herein. Reference numeral 43 denotes a heat collection cover disposed on the thermally responsive element 42 and the heat collection cover is adapted to collect the heat from the thermally responsive element 42, blind-hold the interior of the sprinkler head and present dust from invading into the interior of the sprinkler head.

When the temperature in the area of the sprinkler head rises to an abnormal value due to the occurrence of a fire, for example, the thermally responsive element 42 of the break-up closure assembly 40 senses the abnormal temperature to cause the break-up closure assembly to break into pieces which then drop within the sprinkler head along with the combined presser and guide 50 under their gravity. As a result, the valve member 20 pressed against the valve seat 13 by the break-up closure assembly 40 prior to the breaking-up thereof and the deflector assembly 30 fitting on the valve member also drop by their own gravity until their downward movement is arrested by the flange 14 of the cylindrical frame 15. As the valve member 20 and break-up closure assembly 30 drop in the manner mentioned above, the guide ring 33 and deflector 31 slide down along the inner periphery of the cylindrical frame 15 and along the slide bars 32, 32, 32, respectively. However, since the coil spirng 60 is interposed between the main body 10 and guide ring 33, the guide ring 33 is forced to drop positively to a predetermined position under the force of the coil spring 60.

When the guide ring 33 has been forced to drop to a predetermined position under the force of the coil spring 60, the downward movement of the guide ring is arrested by the radially inwardly extending flange 14 of the frame 15 because the outer diamter of the guide ring is greater than the inner diameter of the flange. However, since the outer diameter of the deflector 31 is smaller than the inner diameter of the flange 14, even after the downward movement of the guide ring 33 has been arrested by the flange, the deflector 31 passes through the flange 13 and continues to move downwardly along the slide bars 32, 32, 32. The downward movement of the deflector 31 is ultimately arrested by the stops 36, 36, 36 at the lower ends of the slide bars 32 and the extinguishing liquid spouting through the nozzle 11 strikes against the deflector to be distributed uniformly out of the sprinkler head.

Figure 5A:
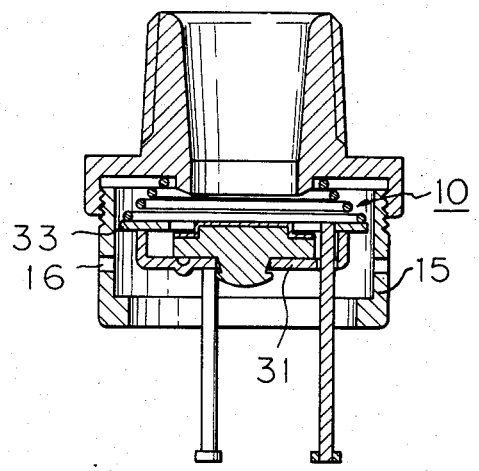
FIGS. 5A, 5B and 5C are vertical sectional views showing the flush type sprinkler head in the inoperative and different operative positions.
Figure 5B:
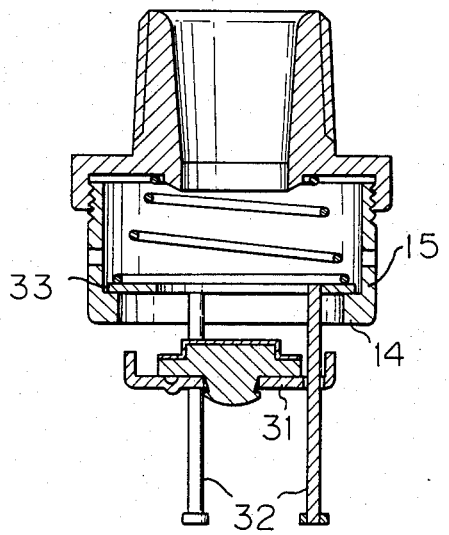
Figure 5C:
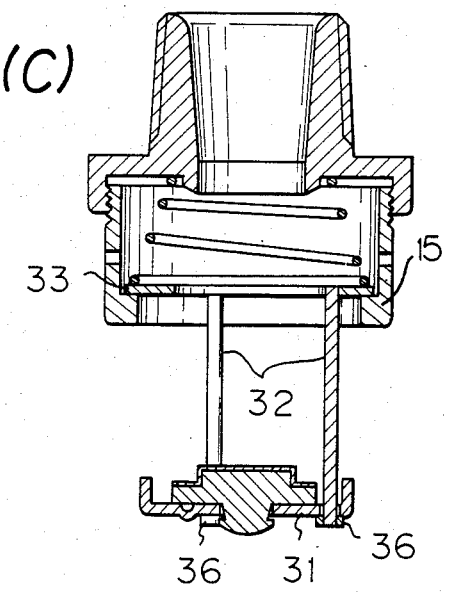

FIGS. 5A, 5B and 5C show the slidable deflector assembly 30 and break-up closure assembly 40 in the normal or inoperative and different operative positions, respectively.

(A) When the temperature in the area of the ceiling sprinkler head rises to an abnormal value as mentioned hereinabove, the break-up closure assembly 40 and combined presser and guide 50 drop to allow the conical coil spring 60 to extend whereupon the guide ring 33 is forced to drop under the force of the extending coil spring which in turn forces the deflector assembly 30 to drop. The components are shown in their inoperative positions prior to the drop in FIG. 5A.

(B) The downward movement of the guide ring 33 is arrested by the radially inwardly extending flange 14 of the cylindrical frame 15, but the deflector 31 is allowed to continue its downward movement along the slide bars 32, 32, 32 (FIG. 5B).

(C) The downward movement of the deflector 31 is arrested by the stops 36, 36, 36 at the lower ends of the slide bars 32, 32, 32 (FIG. 5C).

That is, the sprinkler head according to the present invention operates in two steps. The guide ring 33 having the plurality of slide bars 32, 32, 32 secured thereto is forced to drop by a predetermined distance under the force of the coil spring 60 (in the first step) while allowing the deflector 31 to slide down along the slide bars, 32, 32, 32 extending downwardly from the guide ring by a further predetermined distance until the deflector 31 abuts against the stops 36, 36, 36 at the lower ends of the slide bars whereupon the downward movement of the deflector 31 is arrested thereby (in the second step). Therefore, in the installation of the sprinkler head according to the present invention in the ceiling of a building, even when the sprinkler head is embedded in the ceiling to the degree that the stops at the lower ends of the slide bars are positioned above the plane of the surface of the ceiling, in operation, the deflector 31 can drop to a position substantially below the surface of the ceiling to thereby spray the fire extinguishing liquid uniformly without being interfered with by the ceiling.

As clear from the foregoing description on the preferred embodiment of the invention, although the main body of the sprinkler head has a relatively short length, since the downward movement distance of the deflector is relatively long, the sprinkler head can be installed in the building ceiling protruding by a small distance out of the surface of the ceiling. Thus, the sprinkler head is effectively protected from any external object which may otherwise strike against the sprinkler head and provides an aesthetic appearance to the building ceiling where the sprinkler head is installed. Furthermore, since the sprinkler head also protrudes out of the back side of the building ceiling by a small distance, the sprinkler head will not stand in the way of a piping being installed in the ceiling. Furthermore, even when the sprinkler head of the present invention is installed in the inclined ceiling over an escalator or stairway, in operation, since the coil spring interposed between the main body and guide ring can positively force the guide ring to drop by a predetermined distance, the operation of the sprinkler head is reliable.

While only one preferred embodiment of the invention has been shown and described in detail, it will be understood that the same is for illustration purpose only and not to be taken as a definition of the invention, reference being had for the purpose to the appended claims.

What is claimed is:

1. A flush type sprinkler head comprising:

a vertical cylindrical main body having in an upper portion thereof external threads for threadable engagement with a piping in the ceiling of a building, in a lower portion thereof internal threads and in a central portion thereof an axially extending nozzle provided with a valve seat at the lower end of said nozzle;

a cylindrical frame engaging said valve seat and having at the lower end a radially inwardly extending flange and in an upper portion external threads for threadable engagement with said internal threads of said main body;

a valve member normally abutting against said valve seat to close said nozzle;

a deflector assembly slidably received within said frame surrounding said valve member for downward movement relative to the frame by a first predetermined distance and including a guide ring, a plurality of slide bars extending downwardly from said guide ring and a circular deflector fitted on said valve member for downward movement together with the valve member and relative to the frame along said slide bars by a second predetermined distance which is greater than said first predetermined distance;

a compressed conical coil spring interposed between the undersurface of said main body and the upper surface of said guide ring and adapted to bias said valve member and slidable deflector assembly downwardly upon the operation of said sprinkler head; and a break-up assembly positioned below said slidable deflector assembly and adapted to explode into pieces upon the operation of said sprinkler head.

2. The sprinkler head assembly as set forth in claim 1, in which said cylindrical frame is provided in a peripheral wall of the frame with diametrically opposed horizontal slits each having opposite rounded ends and said break-up assembly includes two diametrically opposing arms for engagement with said slits.

3. The sprinkler head as set forth in claim 1, in which said guide ring has outer diameter smaller than the inner diameter of the peripheral wall of said cylindrical frame but greater than the inner diameter of said radially inwardly extending flange and said valve member and said deflector have outer diameters smaller than the inner diameter of said radially inwardly extending flange.

4. The sprinkler head as set forth in claim 1, in which the outer periphery of said frame is provided with a plurality of spaced parallel grooves to be selectively engaged by a ceiling plate on the ceiling of a building.

* * * * *